United States Patent [19]

Hopkins et al.

[11] Patent Number: 4,586,265

[45] Date of Patent: May 6, 1986

[54] PERSPECTIVE DRAWING APPARATUS

[76] Inventors: William G. Hopkins, 117 Merrifield Dr., Greenville, S.C. 29615; Philip L. Reid, Rt. 2, Box 422, Duncan, S.C. 29334

[21] Appl. No.: 666,104

[22] Filed: Oct. 29, 1984

[51] Int. Cl.[4] ..... B43L 13/14

[52] U.S. Cl. ..... 33/432; 33/27.05; 33/449

[58] Field of Search ..... 33/27 E, 432, 449, 27 R, 33/27 B, 27 H, 448

[56] References Cited

U.S. PATENT DOCUMENTS

| | | | |
|---|---|---|---|
| 1,348,655 | 8/1920 | Moore | 33/432 |
| 1,511,378 | 10/1924 | Strom | 33/449 |
| 3,195,235 | 7/1965 | Regan | 33/449 |

FOREIGN PATENT DOCUMENTS

| | | | |
|---|---|---|---|
| 13313 | of 1884 | United Kingdom | 33/449 |
| 642348 | 8/1950 | United Kingdom | 33/449 |
| 683880 | 12/1952 | United Kingdom | 33/449 |
| 901075 | 1/1982 | U.S.S.R. | 33/432 |

*Primary Examiner*—Robert S. Ward

*Attorney, Agent, or Firm*—Bailey & Hardaway

[57] ABSTRACT

A drafting apparatus having a linear edge with first and second wheel means associated with the edge to rotatably move the linear edge across a planar drafting surface and wherein the wheels are of differing diameter so as to have the linear edge move across an arc defined within a circle toward which the linear edge is always pointed. The center of that circle is the vanishing point as conventionally utilized with perspective drawing techniques.

2 Claims, 5 Drawing Figures

PERSPECTIVE DRAWING APPARATUS

BACKGROUND OF THE INVENTION

This invention relates generally to the art of mechanical drawing and more particularly to an apparatus for utilization during the production of perspective drawings.

The art of mechanical drawing at its simplest level is directed purely to drawings illustrating but a single plane through an object being represented upon a drawing board. More lifelike illustrations are produced utilizing the more complex techniques of oblique and isometric drawings. Such techniques do not truly represent angles and dimensions, but present the subject matter in a manner which is more closely related to the actual perception of a physical object.

The most lifelike presentation upon a drawing board is the utilization of perspective drawings. Perspective drawings utilize vanishing points so that dimensions appear to lessen as distances increase from the point of the viewer. Perspective drawings can be produced utilizing one, two, three and four vanishing points. The technique of utilizing vanishing points produces drawings which are more dramatic and realistic in their appearance. Such vanishing points are generally marked upon the drawing board and drafting instruments are aligned with such vanishing points. A shortcoming, however, of this technique comes about when vanishing points are not located within the bounds of a drawing board or perhaps even within the actual room in which the drawing board is located.

SUMMARY OF THE INVENTION

It is thus an object of this invention to provide a novel apparatus for producing perspective drawings.

It is a further object of this invention to provide such a novel apparatus for producing perspective drawings which does not rely upon physically locating a vanishing point at a precise location within the bounds of the drawing board.

These, as well as other objects, are accomplished by a drafting apparatus having a linear edge with first and second wheel means associatd with the edge to rotatably move the linear edge across a planar drafting surface and wherein the wheels are of differing diameter so as to have the linear edge move across an arc defined within a circle toward which the linear edge is always pointed. The center of that circle is the vanishing point as conventionally utilized with perspective drawing techniques.

DETAILED DESCRIPTION

In accordance with this invention it has been found that a drafting apparatus which is moveable about a planar drafting surface via wheel means of differing diameter generally produces movement about an arc within a circle wherein the center of that circle is a conventional vanishing point. The tool in accordance with this invention thus may be rotatably moved about a drafting board so as to always point to the same vanishing point without ever having to establish the exact location of that vanishing point. Various other advantages and features will become apparent from a reading of the folowing description given with reference to the various figures of drawing.

Figure 1:
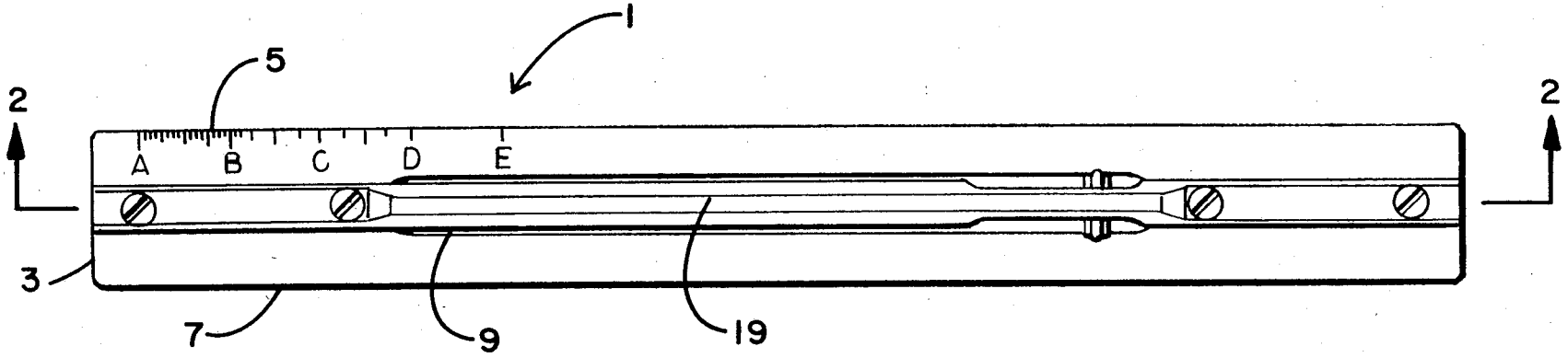
FIG. 1 illustrates in plan view the apparatus of this invention.

FIG. 1 of the drawing illustrates the apparatus 1 in accordance with this invention. The apparatus 1 comprises means 3 defining a linear edge 5 with an opposing linear edge 7. The means 3 is generally in the form of a conventional rule. Means 3 defines within the central portion thereof a slot 9 which may be best viewed in FIG. 2 of the drawings which is a cross section along the line 2—2 of FIG. 1. An axle 11 is mounted within slot 9 and has located thereon first wheel means 13 and second wheel means 15.

Wheel means 15 is of a greater diameter than wheel means 13. Axle 11 is askew to the plane of the linear edge such that wheel means 13 and 15 contact a common plane with the plane of the linear edges of 5 and 7. That linear plane is the planar surface of a drawing board. It can also be seen that the contact points of wheels 13 and 15 is only slightly below the bottom surface of means 3 so as to permit the entire apparatus 1 to be rotatably transported upon wheel means 13 and 15. Linear edges 5 and 7, however, with only slight rotation about wheel means 13 and 15 may be utilized as straight edges upon the planar surface in a generally conventional manner. It has been found that for purposes of conventional drafting that the distance beyond the bottom surface 17 of means 3 beyond which wheel means 13 and 15 extend may be generally in the range of 0.01 to 0.10th of an inch.

Figure 2:
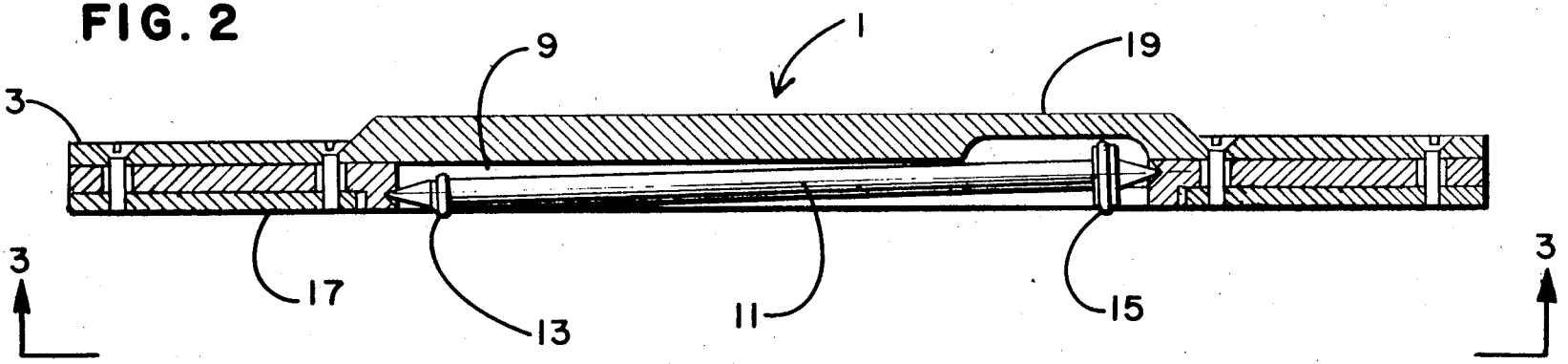
FIG. 2 of the drawings is a sectional view along the line 2—2 of FIG. 1.

A preferred aspect of the invention is illustrated in FIGS. 1 and 2 wherein the top surface of means 3 includes handle means 19 which is generally utilized for handling and placement of the apparatus 1. When the apparatus is rotatably transported from one position on a planar drafting surface to another location, such movement is brought about by gently pressing upon handle 19 in the direction in which travel is sought.

Figure 3:
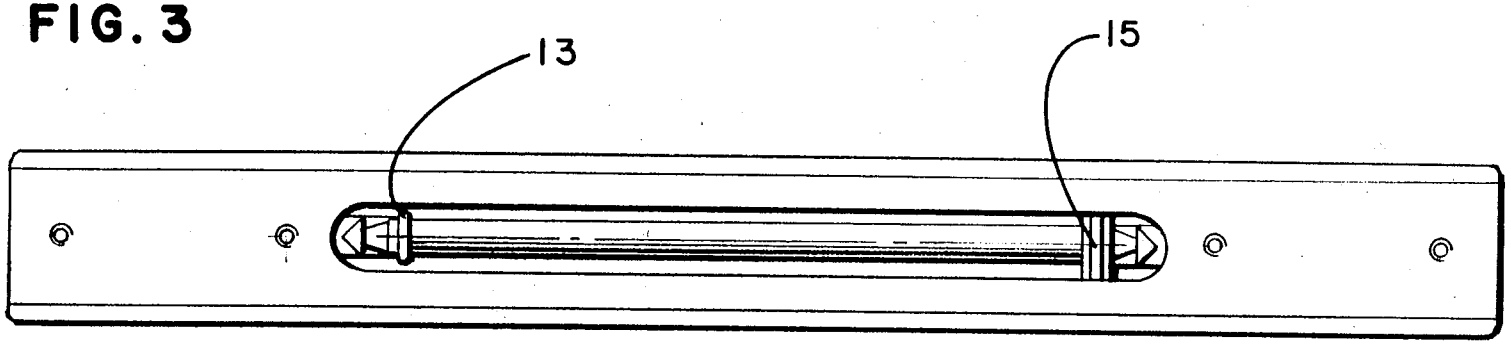
FIG. 3 of the drawings is a view along the line 3—3 of FIG. 2.
Figure 4:
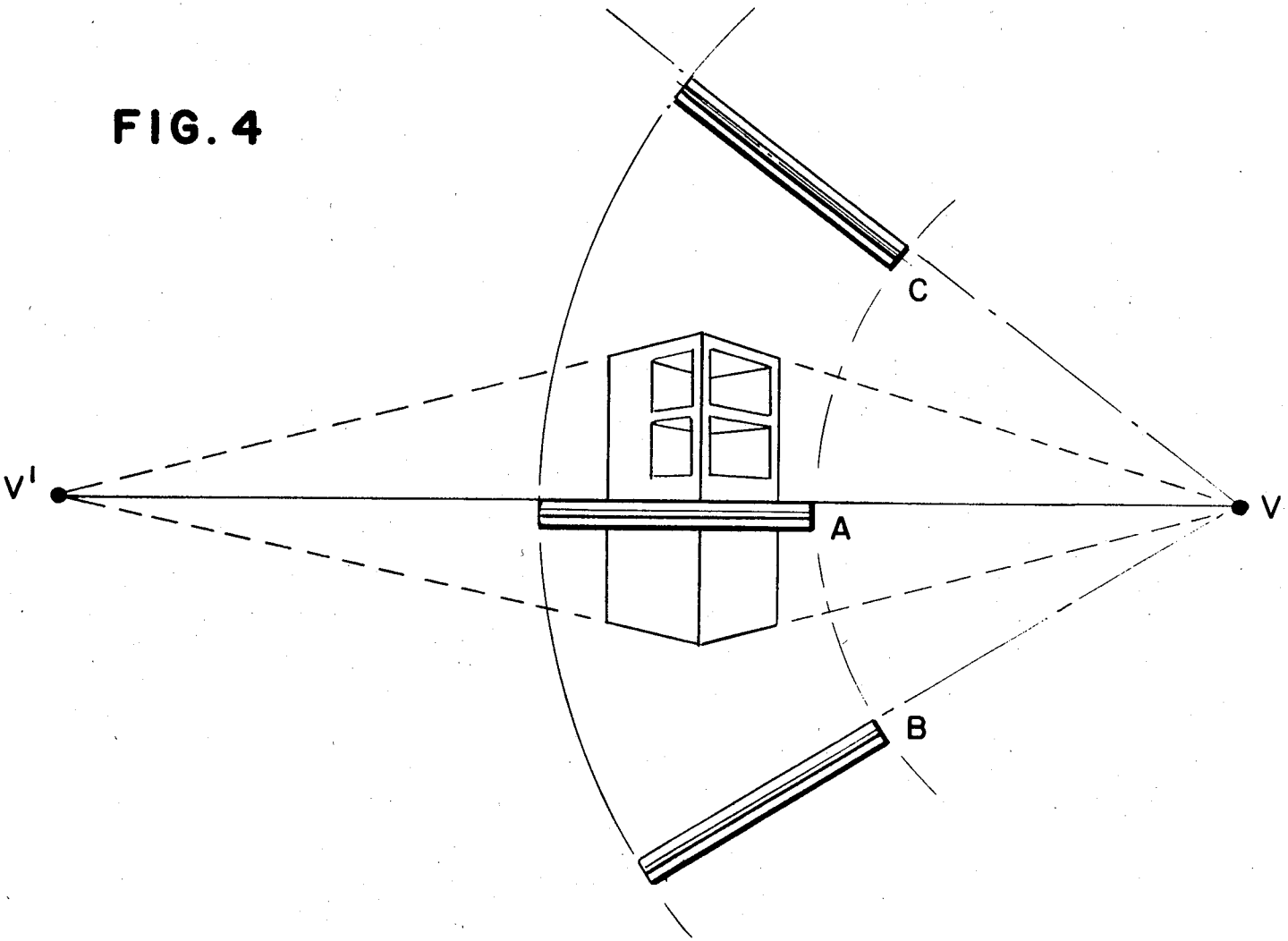
FIG. 4 of the drawings illustrates movement of the apparatus 1 of this invention about a planar surface.

Upon viewing FIGS. 1 and 2 it is seen that wheel means 13 and 15 are in essence segments along a conical surface. This may be best illustrated in FIG. 3 which is a bottom view of the FIG. 1 illustration and generally a view along line 3—3 of FIG. 2. The principle of operation of the apparatus 1 in accordance with this invention can thus be perceived as the rolling of a cone along a planar surface. A cone will always rotate about a circle the center of which is the frustum of the cone. The apparatus of this invention thus always points toward the frustum of the cone of which wheels 13 and 15 are segments. The frustum of the cone is thus also the vanishing point about which the perspective drawing is produced. FIG. 4 of the drawings illustrates a drafting surface with X and Y axes with the apparatus 1 illustrated as pointing toward a vanishing point V when in location A and pointing toward that same vanishing point when in location B. The apparatus is transported from position A to position B and vice versa by the natural movement on wheels 13 and 15. The illustration is, of course, greatly simplified in view of the exaggerated closeness of the proximity of the vanishing point.

The location of the vanishing point in accordance with the apparatus of this invention can of course be varied by varying the diameters of wheel means 13 and 15 and also by varying the location of the apparatus 1 with regard to the X or Y axis. Upon viewing FIG. 4 it is seen that if the apparatus 1 is moved to the left or the right of the Y axis that vanishing point B would of course move a similar distance. A similar event occurs when moving the apparatus for vertical presentations about the X axis. The apparatus may also be provided with means for varying the distance between wheel means and 13 and 15 so as to vary the distance to a vanishing point.

Figure 5:
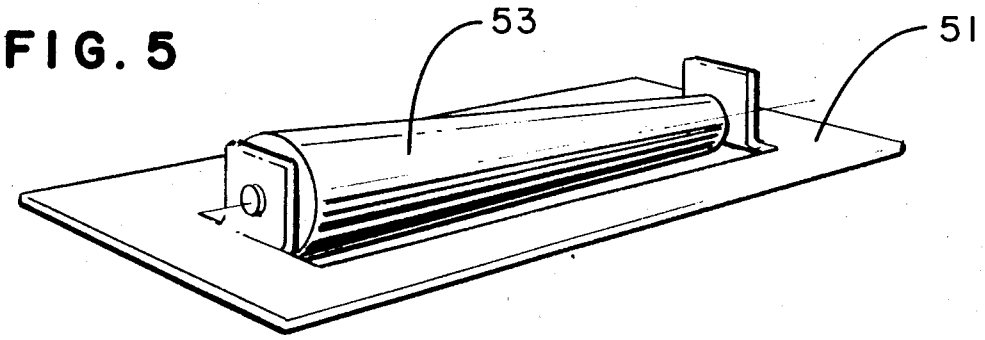
FIG. 5 of the drawings is a perspective view of a different embodiment in accordance with this invention.

The apparatus of this invention is, of course, subject to various modifications. For example, FIG. 5 of the drawings is a view similar to FIG. 3 illustrating an apparatus 51 having a tapered dowel 53 for rotatably moving the apparatus 51. The embodiment of FIG. 5 thus utilizes the entire conical section for producing movement rather than simply wheels about an axle.

It is thus seen that the apparatus in accordance with this invention permits perspective drawings to be produced wherein the apparatus always points to a vanishing point regardless of where that vanishing point is established. The novel apparatus of this invention greatly simplifies the production of perspective drawings. As many variations will become apparent to those of skill in the art from a reading of the foregoing description, such variations are included within the spirit and scope of this invention as defined by the following appended claims.

We claim:

1. A drafting apparatus for use in producing a perspective drawing, comprising:

a rule defining two parallel linear edges and defining in a central portion thereof a slot;

an axle mounted in said slot;

first wheel means mounted on said axle;

second wheel means mounted on said axle; and wherein said first wheel means is of a greater diameter than said second wheel means whereby when said apparatus is rotably moved across a planar surface, said apparatus moves in an arc about a circle toward which one of said linear edges is always directed.

2. An apparatus for producing perspective drawings comprising:

rule means defining a pair of parallel linear edges and defining within the central portion thereof a slot;

a tapered dowel mounted within said slot in a different plane from said linear edges whereby the surface of said tapered dowel when on a planar surface is substantially parallel to said linear edge along said planar surface.

* * * * *